US008594352B2

(12) United States Patent
Frerking et al.

(10) Patent No.: US 8,594,352 B2
(45) **Date of Patent: *Nov. 26, 2013**

(54) ACTIVE CANCELLATION HEARING ASSISTANCE DEVICE

(75) Inventors: Melvin Duane Frerking, Norcross, GA (US); George O'Quinn Hirvela, Carrollton, GA (US); Philip R. Specht, Roswell, GA (US)

(73) Assignee: AT&T Mobility II LLC, Atlanta, GA (US)

( * ) Notice: Subject to any disclaimer, the term of this patent is extended or adjusted under 35 U.S.C. 154(b) by 378 days.

This patent is subject to a terminal disclaimer.

(21) Appl. No.: 12/779,157

(22) Filed: May 13, 2010

(65) Prior Publication Data

US 2010/0220867 A1 Sep. 2, 2010

Related U.S. Application Data

(63) Continuation of application No. 11/213,471, filed on Aug. 26, 2005, now Pat. No. 7,787,648.

(51) Int. Cl.
*H04R 25/00* (2006.01)

(52) U.S. Cl.
USPC ..... 381/317; 381/314; 381/318; 381/71.1; 381/71.6

(58) Field of Classification Search
USPC ..... 381/317, 71.6, 71.1, 71.9, 94.7
See application file for complete search history.

(56) References Cited

U.S. PATENT DOCUMENTS 4,025,721 A 5/1977 Graupe et al.
4,697,283 A 9/1987 Lafrance
5,086,464 A 2/1992 Groppe
5,251,263 A * 10/1993 Andrea et al. ..... 381/71.6
5,430,894 A * 7/1995 Nohara et al. ..... 455/296
5,615,229 A 3/1997 Sharma
5,812,673 A 9/1998 Nohara et al.
5,835,610 A 11/1998 Ishige (Continued)

FOREIGN PATENT DOCUMENTS

WO 2004064483 8/2004

OTHER PUBLICATIONS

Valente et al., "Guidelines for Hearing Aid Fitting for Adults", Am J of Audiology, 7(1):5-13 (Mar. 1998).

(Continued)

*Primary Examiner* — Davetta W Goins
*Assistant Examiner* — Jasmine Pritchard
(74) *Attorney, Agent, or Firm* — Parks IP Law LLC; Jennifer P. Medlin, Esq.

(57) ABSTRACT

An apparatus and method for active cancellation of interference at a hearing assistive devices are presented. The apparatus includes an interference cancellation circuit for cancelling an interference component of a composite signal, and an activator circuit for enabling interference cancellation circuit. The interference cancellation circuit generates an estimated replica of the interference from an interference profile, inverts the replica to form a cancellation waveform, then adds the cancellation waveform to the composite signal to cancel the interference component. An interference profile can be provided by performing a training sequence on a composite signal to detect a repetitive signal and building a profile using its parameters, retrieving a profile stored in memory, or using an antenna to capture an RF signal. The activator circuit may enable the interference cancellation circuit when RF energy is detected, when composite signal characteristics match one or more stored profiles, or in response to user input.

12 Claims, 6 Drawing Sheets

(56) References Cited

U.S. PATENT DOCUMENTS

| | | | | |
|---|---|---|---|---|
| 5,842,115 | A | 11/1998 | Dent | |
| 5,991,420 | A | 11/1999 | Stern | |
| 6,078,675 | A | 6/2000 | Bowen-Nielsen | |
| 6,563,931 | B1 | 5/2003 | Soli et al. | |
| 6,694,034 | B2 | 2/2004 | Julstrom | |
| 6,714,654 | B2 | 3/2004 | Lichtblau | |
| 6,925,179 | B2 | 8/2005 | Waldron | |
| 7,375,616 | B2 * | 5/2008 | Rowse et al. | 340/10.1 |
| 7,433,475 | B2 | 10/2008 | Wakui | |
| 2004/0022398 | A1 | 2/2004 | Yeh et al. | |
| 2004/0234094 | A1 | 11/2004 | Saunders et al. | |
| 2004/0247145 | A1 | 12/2004 | Luo et al. | |
| 2006/0025172 | A1 | 2/2006 | Hawker | |
| 2006/0126873 | A1 | 6/2006 | Lee | |
| 2006/0147069 | A1 | 7/2006 | Svajda | |
| 2006/0188116 | A1 | 8/2006 | Frerking | |

OTHER PUBLICATIONS

Johns et al., "An Advanced Graphic Equalizer Hearing Aid: Going Beyond Your Home Audio System", audiologyonline.com (Mar. 5, 2001).

* cited by examiner

ACTIVE CANCELLATION HEARING ASSISTANCE DEVICE

CROSS REFERENCE TO RELATED APPLICATIONS

This application is continuation of U.S. application Ser. No. 11/213,471, filed Aug. 26, 2005 now U.S. Pat. No. 7,787,648, the entirety of which is herein incorporated by reference.

BACKGROUND OF THE INVENTION

This invention relates in general to hearing assistive devices, and more particularly to hearing assistive devices that actively identify and reduce electronic interference induced in the hearing assistive device circuitry.

Generally speaking, hearing assistive devices including hearing aids worn outside the ear and cochlear implants operate in either a microphone mode, in which sound waves incident upon the device are converted to electrical energy, or a telecoil mode, in which magnetic energy is converted to electrical energy. In either mode, the resultant electrical signal is subsequently amplified, processed, and output to the user. When a hearing aid operates in an environment that includes a modulated RF field or a fluctuating magnetic field, undesired interference may be induced in the hearing aid circuitry as the varying fields are detected and processed as electrical signals by the hearing aid. Because digital devices such as digital cell phones produce RF emissions, the rapidly expanding use of digital wireless communication devices has made electronic interference at hearing assistive devices an increasingly significant problem.

Digital wireless telephones transmit over a wireless network via radio waves. The radio waves generated by the digital telephone are typically detected and demodulated by the hearing aid circuitry, thereby introducing an interference signal to the hearing assistive device. The interference signal is then amplified, processed, and delivered to the user along with the desired signal. As a result, the audible quality of the desired signal is diminished. Digital wireless devices that employ time division multiplexed modulation schemes often generate interference due to the on/off keying of their modulation envelopes. The pulsing of the transmissions may produce interference at the fundamental frequencies associated with the pulse rates, as well as at the associated harmonic frequencies across the audible spectrum. Interference may also be produced by RF energy picked up by components of hearing assistive devices, such as a telecoil in a hearing aid.

The digital telephone's electronics, such as the backlighting, the display, the keypad, the battery leads and the circuit board often also generate pulsed magnetic fields. The resultant magnetic field energy is typically combined with, for example, a hearing aid's wiring and interconnections, to generate interference at the hearing aid. This type of interference, often referred to as baseband magnetic interference, is also converted to an electrical signal that is then processed by the hearing aid, amplified, and delivered to the hearing aid user along with the desired signal, such as the voice of a human speaker. In addition to digital cell phones, digital cordless phones, portable digital radios and other digital devices generate electromagnetic interference which, when processed by the hearing aid, is subsequently output to the user. Analog apparatus such as power transformers, fluorescent lighting, and power lines likewise produce electromagnetic field static that interferes with hearing assistive devices.

Electronic interference, whether generated by pulsating electric or magnetic fields, combines with the desired signals picked up by a microphone, telecoil, or circuitry to form a composite signal at the hearing assistive device. The composite signal is processed by the hearing assistive device and output to the user. Depending on the source and duration of the interference, the hearing assistive device performance may be noticeably and significantly reduced, to the point where the hearing impaired user is discouraged from either using the hearing assistive device, such as a hearing aid, or discouraged from using the item that generates the interference, such as a cellular telephone.

SUMMARY OF THE INVENTION

The present invention overcomes the problems identified in the art by providing a method and apparatus for actively canceling electromagnetic interference at a hearing assistive device. An exemplary method of the invention includes: receiving a composite signal containing both a desired signal waveform and an interference waveform; generating a replica of the interference waveform; creating a cancellation waveform by inverting the replica of the interference waveform; and adding the cancellation waveform to the composite signal to cancel the interference component of the composite signal; thereby producing an interference-cancelled output that approximates the desired signal waveform. The interference-cancelled output is then processed.

A replica of the interference waveform may be produced by one of several methods, or by a combination of methods. In an exemplary method of the invention, an interference replica is generated in real time by an audio processor that monitors the composite signal to detect the presence of a long duration repetitive signal, and produces an interference profile based on that repetitive signal. Alternatively, an RF antenna coupled with a receiver is used to capture RF signals in the vicinity of a hearing assistive device, and an interference waveform is generated based on the received RF signals. A further method of providing an interference replica in accordance with an embodiment of the invention includes utilizing a database of stored interference profiles that represent interference waveforms likely to be encountered by a hearing assistive device user. In compliance with predetermined criteria, an interference profile is selected from the database and used to generate an interference waveform. The interference waveform is then combined with the composite signal to produce an interference-cancelled signal that is delivered to the user.

An apparatus in accordance with the present invention may operate in either a cancellation mode, in which interference is actively cancelled by adding a cancellation waveform to a composite signal, or in a non-cancellation mode, in which interference is not cancelled. Designation of the operational mode may be performed by the user, or by the apparatus, and may be implemented by an apparatus activator circuit. In one embodiment of the invention, the activator circuit is a simple mechanical switch manipulated by the user. Alternatively, the activator circuit includes a controller capable of receiving one or more inputs. For example, the controller may receive input from a user input device, such as a remote control, by which an operator designates the desired operational mode. An exemplary embodiment of the invention includes an RFID reader in communication with a controller, which alerts the controller to the presence of an RFID signal and conveys the informational content to the controller. The controller uses the RFID information as a basis for activating the cancellation mode. In an exemplary embodiment of the invention, the controller is a microprocessor in communication with a memory containing stored interference profiles. The controller can monitor the composite signal, and use a comparison of the composite signal parameters and the stored profiles as a basis for determining when the cancellation mode should be invoked. An activator circuit of the present invention can include an RF sensor in communication with a controller. The RF sensor apprises the controller of the presence of RF energy in the vicinity of the apparatus. The controller can then use the presence or absence of RF energy as a basis for determining whether the cancellation mode should be activated.

When the cancellation mode is activated, a cancellation waveform is generated and added to the composite signal. The resultant output is an interference-cancelled waveform that is input to a signal processor in the hearing assistive device. The signal processor output is amplified and delivered to the user via a speaker. When the cancellation mode is not activated, the composite signal is input to a signal processor and output to the user. Accordingly, an apparatus in accordance with the invention may include a microphone, telecoil, or circuitry for receiving electrical signals; amplifiers for magnifying the received signals; an interference cancellation system for activating the cancellation mode and performing the interference cancellation; a controller for receiving inputs from a microphone, telecoil, or circuitry, and performing signal processing functions; an output amplifier; and a speaker for delivering sound to the user.

Embodiments of the interference cancellation system in accordance with the invention may include an activator circuit as well as an interference cancellation circuit. The activator circuit may include a controller communicatively coupled with an RF sensor, a memory, an RFID reader, or a user input device, or any combination thereof. An interference cancellation circuit of the present invention may include an interference processor, which generates an interference waveform based on profiles provided by an audio processor that monitors the composite signal, an RF receiver, or a memory with stored profiles, or any combination thereof.

Accordingly, the problems identified in the art are solved by embodiments of the invention that are configured to actively cancel interference induced in the circuitry of a hearing assistive device by providing a cancellation waveform that is combined with a composite signal, which includes both desired signal as well as undesired interference. The cancellation waveform cancels the interference component of the composite signal. The interference-cancelled signal, which approximates the desired signal, is then amplified and output to the hearing assistive device user to provide higher quality audio than is attainable with conventional hearing assistive devices.

DETAILED DESCRIPTION

In general, the devices and methods presented herein are directed toward providing a Hearing Assistive Device (HAD) that actively eliminates interference received at the HAD. The invention as taught can be used to cancel RF interference generated by digital devices, such as but not limited to, digital cellular telephones, digital cordless phones, and portable digital radios, allowing a HAD-equipped user to operate such devices without experiencing audio signal degradation due to the presence and amplification of RF interference. The present invention can also be used to eliminate interference from analog apparatus, such as power transformers, fluorescent lighting, and power lines that produce strong electromagnetic field static that are frequently inductively coupled into telecoil-equipped HADs. By eliminating the interference, the invention allows a user to avoid the irritating humming sound that may result when the alternating-current interference is amplified. For the non-limiting purpose of teaching the present invention, the illustrated embodiments and description are directed to the electromagnetic interference generated by a digital cellular telephone and received by a hearing aid.

As required, detailed embodiments of the present invention are disclosed herein. It must be understood that the disclosed embodiments are merely exemplary of the invention that may be embodied in various and alternative forms, and combinations thereof. The figures are not to scale, and some features may be exaggerated or minimized to show details of particular components. In other instances, well-known materials or methods have not been described in detail in order to avoid obscuring the present invention. Therefore, specific structural and functional details disclosed herein are not limited but serve as a basis for the claims, and for teaching one skilled in the art to variously employ the present invention.

Figure 1:
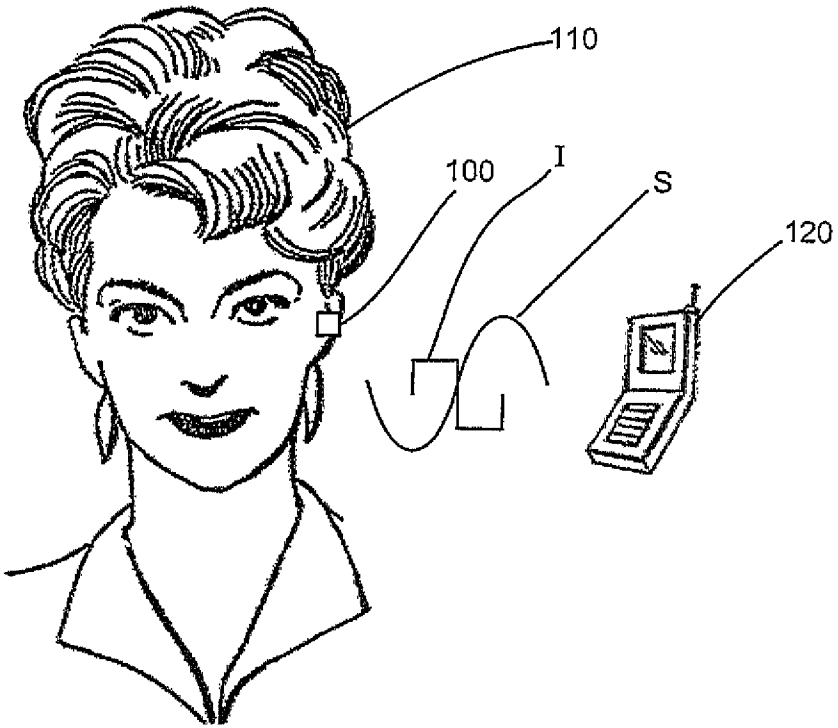
FIG. 1 illustrates an exemplary embodiment of an Active Cancellation Hearing Assistive Device (ACHAD), in accordance with the present invention.

Referring now to the drawings, wherein like numerals represent like elements throughout, FIG. 1 depicts a user 110, equipped with an Active Cancellation Hearing Assistive Device (ACHAD) 100 according to the present invention, operating a digital cellular phone 120. As seen from the figure, the digital cellular phone 120 outputs a desired signal S from its speaker, and also produces interference I. The interference I can result from RF emissions generated by the digital cellular phone 120. The RF transmissions emitted by the digital cell phone 120 during its operation create a pulsing electromagnetic field around the antenna of cell phone 120, which is often picked up by a microphone, a telecoil, or the circuitry in the ACHAD 100, and perceived as a buzz or similar disturbance in the ear of user 110. Interference I is also often produced when the cell phone 120 is configured to operate using a Time Division Multiplexed (TDM) transmission format, for example, a GSM, TDMA or iDen format. Transmitting a digital pulse train over a shared TDM frequency channel requires rapid on/off keying of a transmitter. The rapid switching generates a fluctuating electric field around the phone that is detected and demodulated by the ACHAD 100 as interference within the audible spectrum.

Alternatively, interference I can result from fluctuating electromagnetic fields generated by the digital circuitry, backlighting, display, keypad or battery leads of the digital cellular phone 120. The electromagnetic field can be detected by a telecoil positioned within the ACHAD 100. An electrical current is then induced in the ACHAD 100 circuitry in proportion to the field strength and behaves in a manner similar a desired electrical signal. Interference can also result when an RF signal is inductively coupled to a telecoil-equipped ACHAD 100. As shown in FIG. 1, the user 110 is able to use the digital cell phone 120 without experiencing the annoyance of a buzzing noise or poor signal quality due to interference I, because the ACHAD 100 eliminates the detected interference I prior to transmitting sound to the user 110.

Figure 2A:
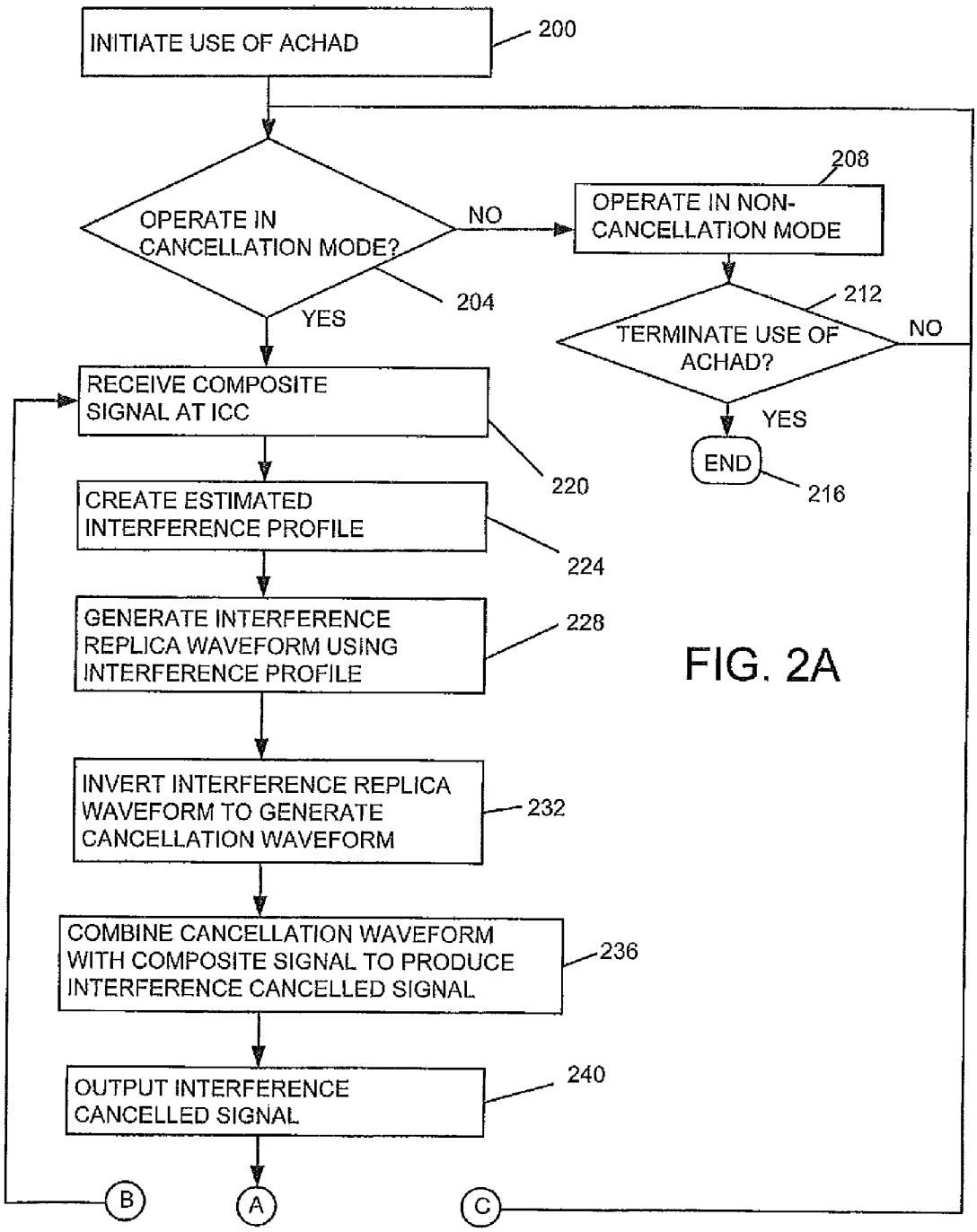
FIGS. 2A-2B show a flowchart illustrating an exemplary cancellation method, in accordance with the present invention.
Figure 2B:
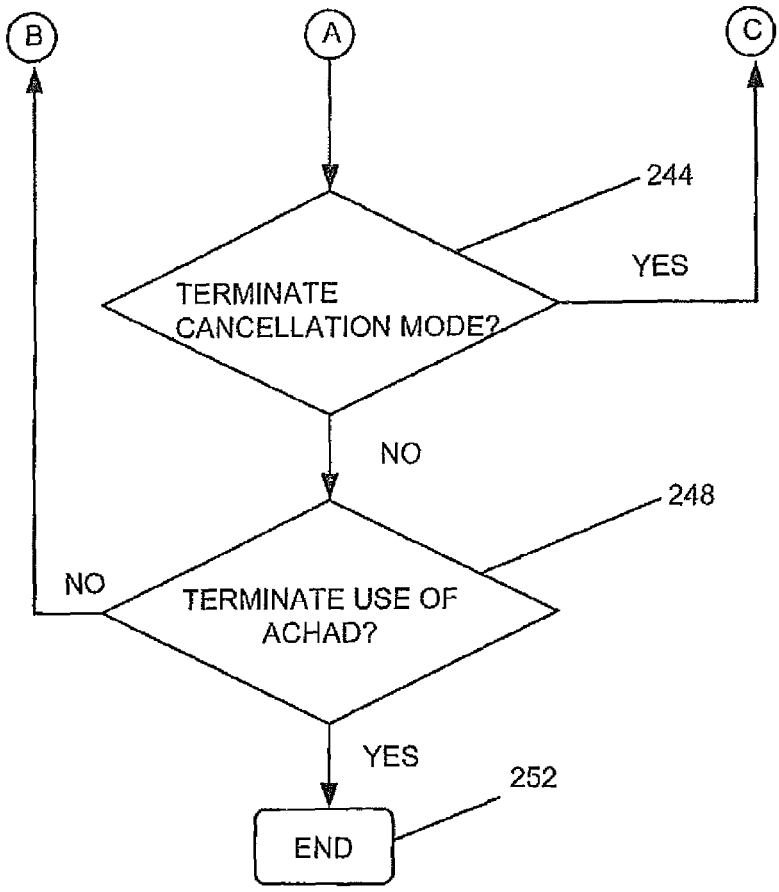

FIG. 2 shows a flowchart that depicts the general manner in which an exemplary embodiment of an ACHAD 100 operates, in accordance with the present invention. The ACHAD 100 may be operable in two modes, a cancellation mode in which interference cancellation circuitry (ICC) is activated, and a non-cancellation mode in which the ICC is bypassed. The first step in the process is to initiate use 200 of the ACHAD 100 by turning the power on. During operation of the ACHAD 100, a decision 204 is made regarding the operation mode. The decision can be made by the user 110 of the ACHAD 100 who may select the mode by pressing a switch or by remotely signaling the ACHAD 100 with a separate programming device. Alternatively, the decision can be made by an ACHAD 100 controller based on detected signal and sensor information.

When the ACHAD 100 operates in a non-cancellation mode 208 the ICC is not activated. In the non-cancellation mode 208, the composite signal of S+I at the ACHAD 100 is processed in a conventional manner as known in the art; i.e. it is converted to a digital format, manipulated, converted to an analog format, amplified, and output from a speaker to the user 110. However, as long as the ACHAD 100 is in use, the mode may be switched to the cancellation mode when conditions so warrant. The user 110 can decide to terminate use of the ACHAD 100 at some point 212; if so, the ACHAD can be powered down 216.

When the ACHAD 100 operates in a cancellation mode the ICC is activated and the composite signal at the ACHAD 100 is input to and received 220 by the ICC. The ICC creates 224 an estimated interference profile of an interference signal or waveform within the composite signal. There are a variety of methods by which the interference profile or waveform may be created. It can be generated in real time by an audio processor that monitors the composite signal to detect the presence of an interference component. It can also be formed from an RF signal received at an antenna. Alternatively, an interference profile can be created by accessing a database of stored profiles that represent the types of interference likely to be encountered when the user 110 is in the vicinity of RF interference-producing digital or analog devices.

Following the creation or designation 224 of an estimated interference profile, an interference replica is generated 228. A cancellation waveform can then be generated 232 by inverting the estimated interference replica in phase. This may be done by a variety of commonly used hardware circuits or software well known to one skilled in the art. The inverted or cancellation waveform is then added 236 to the composite signal, so that interference waveform at the ACHAD 100 is canceled. The resultant interference-cancelled signal is then output 240 from the ICC to a signal processor and processed in the manner described for the non-cancellation mode of operation 208, namely it may be digitized, manipulated, and amplified prior to output to the user.

At this point in the process, a decision 244 may be made whether to terminate the cancellation mode of operation. The decision can be made by the user of the ACHAD 100 who may employ a switch or external programming device to terminate the cancellation mode; alternatively the decision can be made by the ACHAD 100 controller based on available signal and sensor information. If the cancellation mode is not terminated, the composite signal received by the ACHAD 100 receiver continues to be input to the ICC. If the cancellation mode is terminated then the decision 204 regarding operational mode is repeated and the ACHAD 100 can operate in a non-cancellation mode. The user 110 can also decide to terminate use of the ACHAD 100 at decision 248, and accordingly can power down 252 the ACHAD 100.

Figure 3:
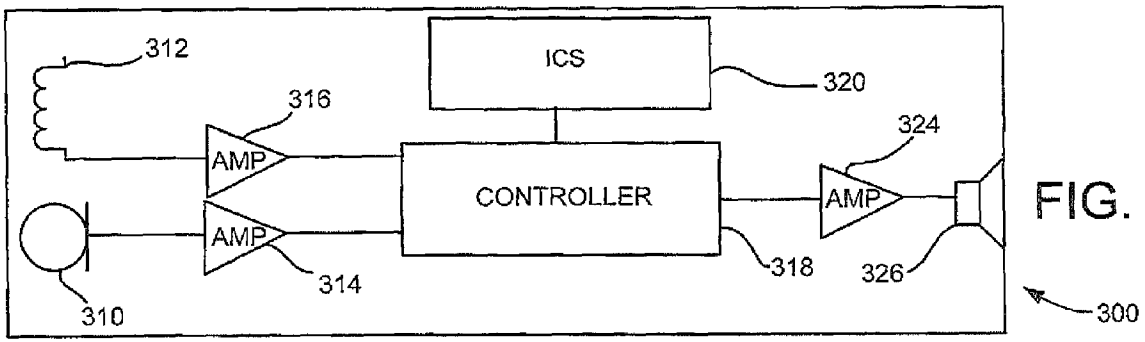
FIG. 3 is a block diagram of an exemplary embodiment of an Active Cancellation Hearing Assistive Device, in accordance with the present invention.

Referring now to FIG. 3, a block diagram of an exemplary embodiment is shown, wherein the ACHAD 100 is in the form of a hearing aid 300. The hearing aid 300 includes one or more input devices, such as a microphone 310 for picking up sound audio signals and/or a telecoil 312 for picking up electrical audio signals. These input devices 310, 312 typically receive both a desired signal S and an interference waveform I, which are combined to form a composite signal, as further explained below. Signals from the microphone 310 are provided to a first amplifier 314; similarly, signals from the telecoil 312 are provided to a second amplifier 316. Although depicted as separate devices, first and second amplifiers 314 and 316 can be integrated with their respective input devices, namely the microphone 310 and the telecoil 312. Outputs from amplifiers 314 and 316 are input to a controller 318, which is coupled to an Interference Cancellation System (ICS) 320.

The ICS 320 eliminates interference from the hearing aid 300 by producing a replica of the interference waveform I and inverting it in phase to create a cancellation waveform, and combining the cancellation waveform with the composite signal. The interference-cancelled output of the ICS 320 is then input to the controller 318 for signal processing. The output from the signal processor is then input to output amplifier 324 for boosting the output signal prior to its delivery via a speaker 326. Related elements, such as but not limited to, a power supply and power and communication buses, are not shown, so that the novel features of the present invention may be emphasized. It will be understood that the functional entities depicted in the figures contained herein can be variably arranged without departing from the scope of the claims.

In operation, the hearing aid 300 receives a desired signal S and undesired interference I, which combine to form a composite signal S+I. If operating in a non-cancellation mode, the composite signal can be processed without being sent to the ICS 320. The composite signal of S+I is then output to the hearing aid 300 user. When operating in the cancellation mode the composite signal is diverted to the ICS 320, which receives the composite signal from the controller 318, creates a replica of an interfering waveform of the composite signal, inverts the replica to form a cancellation waveform, and adds the cancellation waveform to the composite signal to cancel the interfering waveform from the composite signal.

Figure 4:
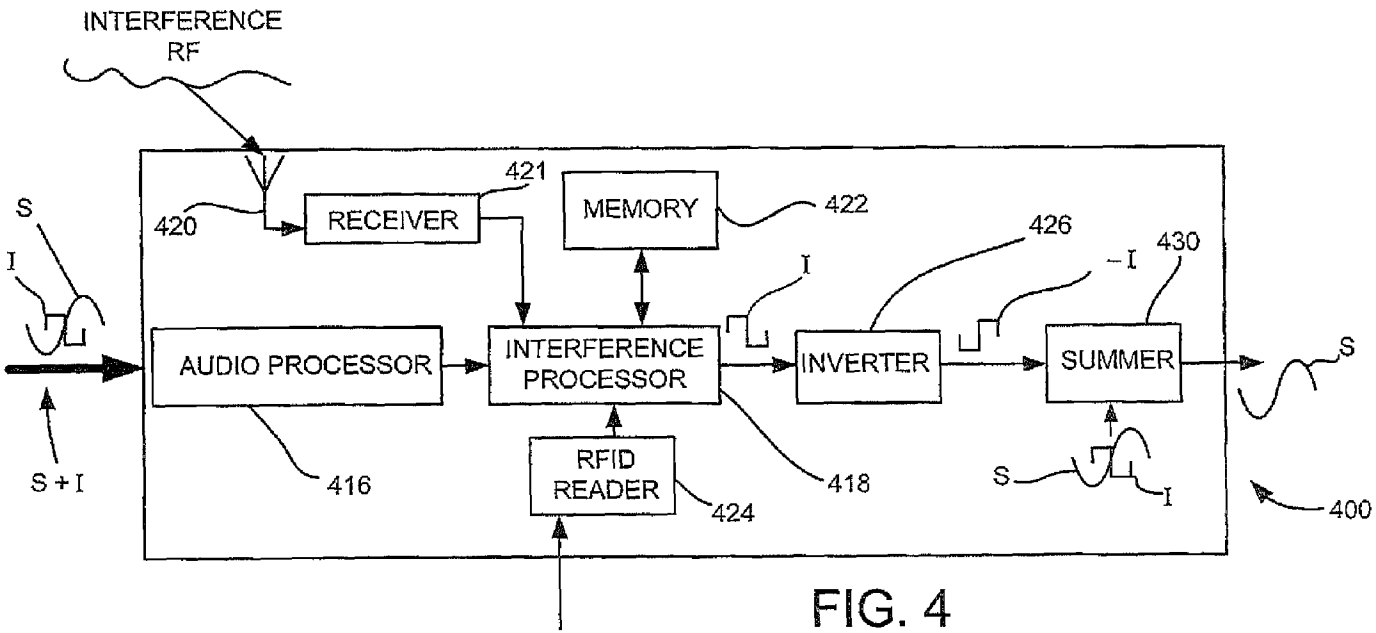
FIG. 4 is a block diagram of an exemplary embodiment of an Interference Cancellation Circuit, in accordance with the present invention.

As discussed above, when the cancellation mode is selected the composite signal is provided to the ICS 320. FIG. 4 shows an exemplary Interference Cancellation Circuit (ICC) 400 that forms a part of an ICS 320. When the ACHAD operates in the cancellation mode the ICC 400 is enabled, which provides the composite signals input to the controller 318 are directed to the ICC 400 for interference cancellation. In cancellation mode, the signal input at controller 318 is a composite signal that includes a desired signal S and undesired interference I. Desired signal S may be speech that has been transduced by a microphone from a sound wave to an electric signal. Alternatively, desired signal S may be speech that has been transformed to an electrical signal through inductive coupling of electromagnetic field energy by a telecoil. Sounds of interest other than speech can also form the basis of desired signal S. For the non-limiting purpose of teaching the invention, undesired interference signal I is presumed to be generated by a magnetic field or a modulated RF field of a digital cell phone. However, interference I may alternatively derive from any of the aforementioned sources of interference.

The illustrated ICC 400 includes an interference processor 418 that produces an estimated interference waveform that is a replica of the interference component I of the composite signal S+I. The three inputs to interference processor 418, namely, a receiver 421, memory 422, and an RFID reader 424, as described below, represent possible sources of interference profiles, and are collectively referred to herein as interference profile providers. The interference profiles supplied by the interference profile providers are used to generate an interference replica. The interference profile can be a set of parameters that characterize a waveform, or an actual waveform. The interference replica is then inverted to produce a cancellation waveform, which is subsequently added to the composite signal in order to cancel the interference component.

There are several methods by which an interference profile may be produced. In one embodiment, the ICC 400 includes an audio processor 416 that accepts the incoming composite signal containing desired signal S and interference I components. Based on the characteristics of the composite signal, the audio processor 416 performs a training sequence to develop an interference profile. The interference component I of the composite signal is considered a deterministic waveform that is modeled by a continuous waveform pattern that exhibits a fairly consistent pattern of frequency and amplitude characteristics over time. The desired signal component S, however, may fluctuate over time, particularly if the desired signal is speech that is often interrupted by pauses, or if the signal S represents coincident sound from multiple sources. In performing a training sequence, the audio processor 416 monitors the incoming composite signal and extract signal characteristics, such as but not limited to amplitude and frequency, over time to detect the presence of a repetitive signal. The parameters of the repetitive signal are then used to produce an interference profile that estimates the interference component I of the composite signal. The audio processor 416 can monitor the total spectral energy of the composite signal.

The audio processor 416 can also use satisfaction of a predetermined power threshold as a basis for generating an interference profile. For example, when the power level at a particular frequency satisfies a predetermined threshold, the audio processor 416 determines that an interference component I is present at that frequency and subsequently composes an interference profile based on signal characteristics at that frequency. After the audio processor 416 completes the training sequence and constructs an interference profile, it outputs the interference profile to the interference processor 418. The interference processor 418 uses the interference profile to generate an interference replica. This method of producing an interference profile allows real-time adjustment of the interference cancellation waveform to respond to changes in the composite signal.

An ICC 400 in accordance with the invention can accept input from an antenna 420, in communication with a receiver 421, to capture external RF signals in the vicinity of the user, and thus provide an RF signal that is separate from the composite signal. Because the RF signal captured by the antenna 420 and received and demodulated by the receiver 421 may be generating audio band interference, replicating the RF signal received at receiver 421 is another way of producing an interference replica. The RF signal received at receiver 421 is sampled for signal parameters such as, but not limited to, frequency and amplitude information in order to construct an interference profile. Because the antenna 420 continually receives the RF energy present, the interference profile based on the RF signal at receiver 421 can be updated in real time to reflect changes in the RF signal, allowing the ICC 400 to adapt to a changing RF environment.

In an exemplary embodiment, an ICC 400 in accordance with the invention can include a memory 422 in communication with an interference processor 418. The memory 422 provides a database of stored interference profiles and also stores programming instructions for the interference processor 418. The stored interference profiles contain pertinent signal parameters associated with interference waveforms likely to be encountered. By way of example and not limitation, the stored interference profiles represent amplitude and frequency information for a variety of waveforms. The stored interference profiles may be loaded into the memory 422 at the time of manufacture of the ACHAD 100, or alternatively, when it is dispensed by the patient's audiologist.

Further, the database may be updated by an audiologist when additional interference profiles are available. Thus, as new digital devices appear on the consumer market, and new interference patterns are created, the ACHAD 100 may continue to effectively eliminate interference and provide quality sound to the user. The memory 422 can also store interference profiles developed by other interference profile providers, such as the audio processor 416, or the antenna 420 and receiver 421, so that those profiles may be accessed in the future.

In an exemplary embodiment the interference processor 418 performs a matching algorithm to compare a repetitive signal detected by the audio processor 416 to one or more interference profiles stored in memory 422. Using predetermined criteria, the interference processor 418 determines whether at least one stored interference profile is a best match with the repetitive signal. If so, the best match interference profile is used to generate an interference replica waveform.

The interference processor 418 can also be programmed to use specific signal parameters to select an interference profile from the memory 422. In an exemplary embodiment, the interference processor 418 is programmed to select an interference profile based on the frequency spectrum of the composite signal. For example, when a composite signal contains a dominant 60 Hz component, the interference processor 418 retrieves a stored interference profile associated with a 60 Hz frequency. Because wireless network service providers operate with different technologies and transmission formats, they produce interference patterns at different frequencies. By storing profiles associated with the various transmission formats in memory 422, the interference processor 418 provides frequency-specific interference profiles that are effective for identifying and reducing interference produced by digital devices associated with a variety of wireless networks.

Alternatively, interference profiles may be selected by the interference processor 418 according to device identification information. When the ACHAD 100 is equipped with an RFID reader 424 the interference processor 418 uses information gathered by the RFID reader 424, for example, from an RFID tag on the digital cell phone 120, to identify the electronic device. An interference profile is then selected based on the device identification. More specifically, an RFID tag on the cell phone 120 may identify the manufacturer and model number of the phone, which is then used by the interference processor 418 to retrieve an interference profile associated with the particular cell phone 120. Alternatively, the RFID tag on the digital cell phone 120 may identify it as a digital cell phone transmitting in a GSM format, in which case an interference profile associated with a device operating in a GSM format would be selected.

The block diagram of FIG. 4 depicts the interference processor 418 as having inputs from interference profile providers, namely, the audio processor 416, the antenna 420 with an associated receiver 421, the memory 422, and the RFID reader 424. An embodiment of the invention can include one or more of the interference profile providers described. The interference processor 418 can accept interference profiles from any one or more of the interference profile providers included in the ICC 400. If more than one interference profile is input to the interference processor 418, the interference processor 418 is programmed to select a particular interference profile based on predetermined criteria. The interference processor 418 can perform a matching algorithm to compare the composite signal, or a repetitive component of the composite signal, with at least one interference profile to determine a best match or optimum interference profile for eliminating the interference component of the composite signal. When an optimum interference profile is selected, the interference processor generates an interference replica waveform based on the optimum interference profile. Alternatively, the interference processor 418 may select more than one interference profile. For example, an interference replica waveform can be generated based on each of the interference profiles selected.

The methods of providing an interference profile discussed above, which were described as separately performed at a particular interference profile provider, namely the audio processor 416, the receiver 421, or the memory 422, can be combined to create an interference profile. For example, two or more interference profiles from different profile providers can be combined to form a single interference profile that is then be stored in the memory 422 for future accessibility. Alternatively, signal information from a first interference profile provider may be shared with the interference processor 418 or with a second interference profile provider in order to create or select an interference profile. By way of example and not limitation, signal parameters derived from the receiver 421 can be used by the interference processor 418 to select a stored interference profile from the memory 422. For example, if the antenna 420 and receiver 421 receive a 60 Hz signal, the interference profile associated with a 60 Hz signal is retrieved from memory 422 by interference interference processor 418. Likewise, frequency information from receiver 421 is shared with audio processor 416, so as to tune the audio processor 416 to particular frequencies.

After an interference profile has been selected by the interference processor 418, the signal parameters contained in the interference profile are used to generate an estimated interference waveform that is intended to replicate the interference component I of the composite signal. The interference replica waveform is then output from the interference processor 418 and used to create a cancellation waveform.

The ACHAD 100 identifies and reduces interference in its circuitry by producing a cancellation waveform −I that cancels the interference component I of the composite signal. Accordingly, the estimated interference waveform output from the interference processor that replicates I is input to an inverter. The function of the inverter 426 is to output a cancellation waveform −I. The cancellation waveform output from the inverter 426 is then input to a signal summer 430. The signal summer 430 also receives as an input the composite signal S+I. The summer 430 adds the composite signal S+I to the cancellation waveform −I and outputs a signal that approximates S, the desired signal component of the composite signal. The summer 430 output can then be input to a signal processor where it is processed in a manner understood by those skilled in the art.

Figure 5:
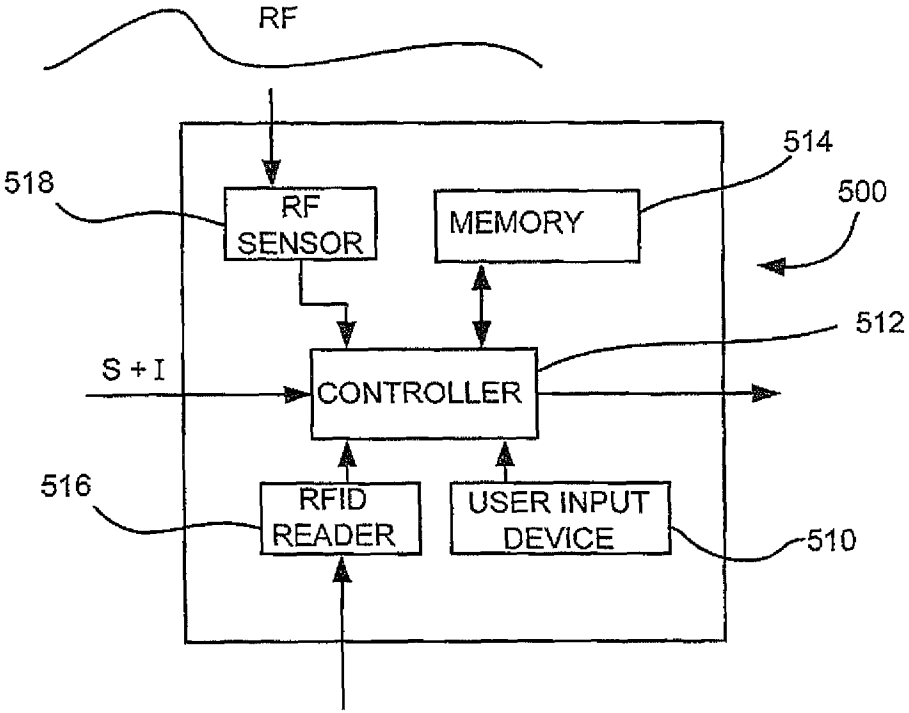
FIG. 5 is a block diagram of an exemplary embodiment of an Activator Circuit, in accordance with the present invention.

As discussed above, the ACHAD 100 may operate in a cancellation or a non-cancellation mode. Accordingly, in addition to including the ICC 400, the ICS 320 of FIG. 3 may include an activator circuit that is used to designate the appropriate operational mode. FIG. 5 depicts an exemplary embodiment of an activator circuit that activates the ICC 400, or in other words, enables the ACHAD 100 to operate in the cancellation mode. As shown in FIG. 5, the illustrated activator circuit 500 includes a controller 512 in communication with a user input device 510, an RFID reader 516, an RF sensor 518, and a memory 514. An activator circuit in accordance with the invention may include any one or more of the controller inputs depicted in FIG. 5.

In one embodiment, the operational mode is selected by the user 110. Controller 512 is a mechanical switch that is accessible to a user 110 who turns on the switch to enable the interference cancellation mode when he or she hears interference or static. He may also decide to avoid the possibility of hearing interference by switching on the interference cancellation mode prior to using a digital device or entering an environment where interference is expected. The ACHAD 100 continues to operate in a cancellation mode until the user decides to alter the mode. Alternatively the user selects the mode via a user input device 510, which may be a remote control device used to wirelessly transmit commands to controller 512. In addition to being used for turning the cancellation mode on or off, the remote control device is used to program the ACHAD 100 to operate in a cancellation mode for a particular time duration, or according to particular signal parameters.

Alternatively, the controller 512 can be a microprocessor in communication with a memory 514 containing stored interference profiles. The controller 512 monitors the composite signal. Signal characteristics such as, but not limited to, power and frequency as measured and compared with at least one profile stored in memory 514, are used to determine when the cancellation mode should be activated. Repetitiveness of particular audio band components, and/or increases in acoustic levels that satisfy predetermined thresholds can be used as a basis for activating the ICC 400. The results of a comparison of the composite signal, or the repetitive component of the composite signal with at least one stored profile can be used as a basis for activating interference cancellation circuit when the comparison results satisfy predetermined criteria. The stored profiles can be stored in the memory 514 at the time of manufacture or later by the patient's audiologist when the ACHAD 100 is dispensed. The profiles can also be updated at a later time by remote programming.

In some embodiments, the profiles represent power level thresholds at particular frequencies. The controller 512 detects power levels at various frequencies associated with the composite signal and compares them to one or more profiles stored in memory. When the power at a particular frequency satisfies or exceeds the threshold of the profile, that can be an indication that interference is present; accordingly, the controller 512 activates the cancellation mode of operation.

In an exemplary embodiment of the invention, the controller 512 can be in communication with a radio frequency identification (RFID) reader 516. The RFID reader 516 is a transceiver configured to transmit RFID interrogation signals as well as accept transmissions from an RFID tag. Regarding some embodiments, an RFID tag positioned on the digital cell phone 120 can provide information regarding identification as a digital device, manufacturer identification, signal characteristics, transmission format, and possibly even information regarding interference profiles associated with the device. An RFID reader 516 in communication with controller 512 can detect a signal from the RFID tag, alert the controller 512 to the presence of a RFID signal, and communicate its informational content. The controller 512 can use the detection and/or identification of a proximate digital device as a basis for activating the ICC 400. When the RFID reader no longer receives a response, the controller 512 terminates the cancellation mode of operation.

In alternative embodiments, the activator circuit 500 includes an RF sensor 518 in communication with the controller 512. The RF sensor 518 is any sensor that responds to the presence of RF energy. The RF sensor 518 can be a simple passive sensor in the form of a module that resonates in the presence of RF energy. When the RF sensor 518 is excited a detection signal is sent to the controller 512. Alternatively, the RF sensor 518 can be more complex, providing narrowband RF filters directed toward frequency bands of interest and may determine the power levels at particular frequencies by using spectrum analysis, FFT, or other methods known in the art. When a predetermined power threshold is satisfied the RF sensor communicates a detection signal to the controller 512, which can include frequency and power information, and the controller 512 subsequently activates the cancellation mode of operation. Conversely, the absence of a detection signal from the RF sensor 518 can be a basis for the controller 512 to enable the non-cancellation mode of operation.

Figure 6:
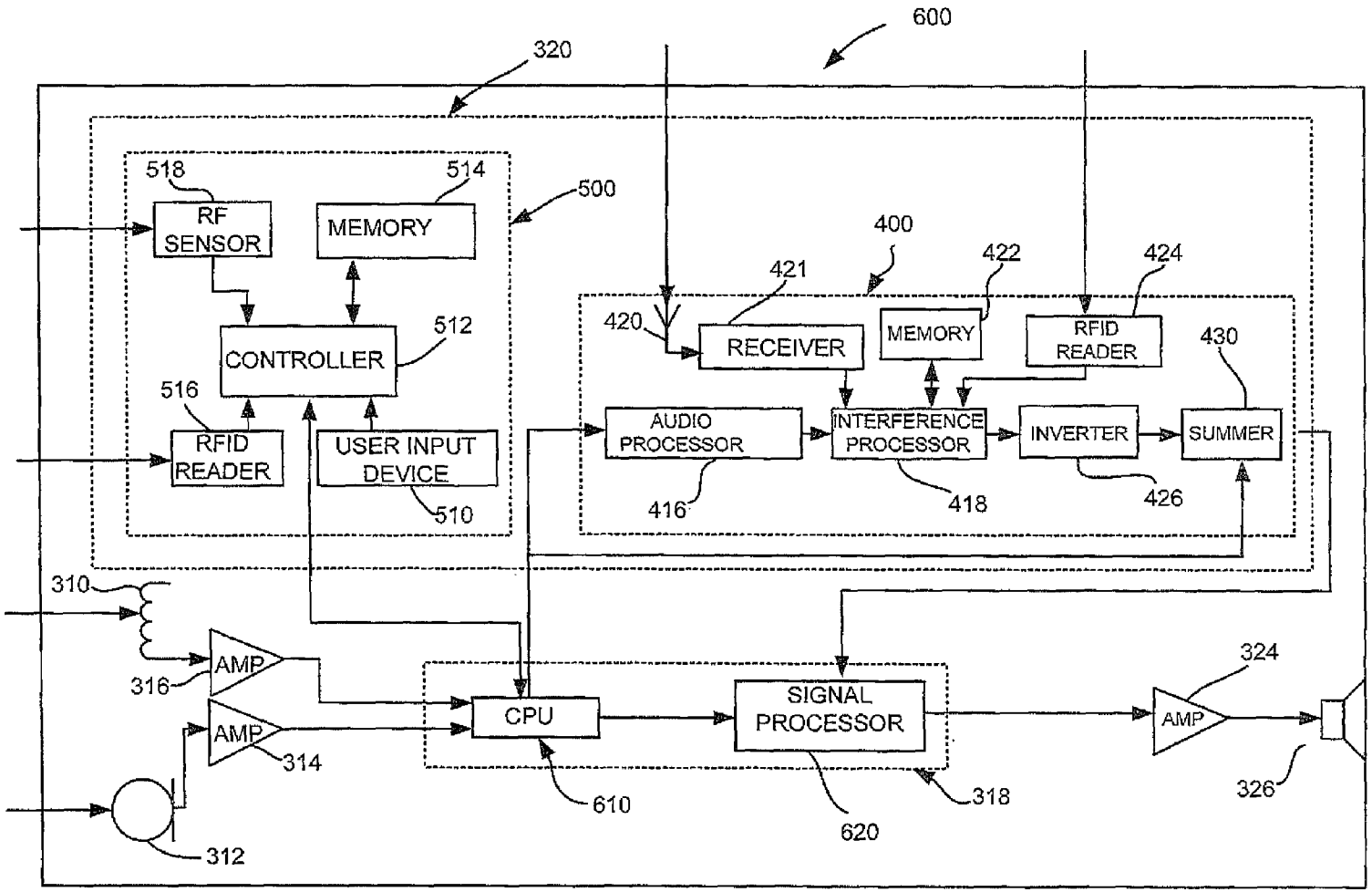
FIG. 6 is a block diagram of an exemplary embodiment of a hearing aid incorporating an Interference Cancellation Circuit and Activator, in accordance with the present invention.

Turning to FIG. 6, there is shown an embodiment of a hearing aid 600 in accordance with the invention, which includes an ICS 320 having an ICC 400 and an activator circuit 500. The hearing aid 600 also includes a controller 318, an output output amplifier 324, and a speaker 326. As shown in the illustrated embodiment, signals can be input to hearing aid 600 via a microphone 310 and/or a telecoil 312. The input signals can be amplified by first and second amplifiers 314 and 316. Where undesirable electromagnetic interference is induced in the hearing aid 600 circuitry, a composite signal of S+I containing desired signal S and undesired interference I is received by the controller 318.

Here, the controller 318 includes a CPU 610 and a signal processor 620. The CPU 610 accepts the composite signal and provides access to the composite signal by activator circuit 500 so that a decision can be made regarding the operational mode. If the hearing aid operates in a cancellation mode, the CPU 610 directs the composite signal to the ICC 400 so that an interference component can be cancelled. The resultant interference-cancelled signal is then input to the signal processor 620 of controller 318. If the hearing aid is not operating in a cancellation mode, the CPU 610 directs the composite signal directly to the signal processor 620 where the hearing aid's normal adaptive filtering and other signal manipulations can be performed. Not shown are optional analog-to-digital and digital-to-analog converters, which may be present prior to and after the signal processor 620 when digital signal processing is performed. The output of signal processor 620 is input to an output amplifier 324 where it is amplified prior to being output as sound by speaker 326.

Here also, the activator circuit 500 activates the ICC 400 in response to user input, which may be user manipulation of a switch or user commands from an input device 510, such as a remote control device. Alternatively, the decision regarding operational mode may be made according to one or more of the methods described above, or some combination thereof. When activated, the ICC 400 produces a cancellation waveform designed to cancel the interference component I of the composite signal. To form the cancellation waveform, the interference processor 418 generates and outputs a replica of the interference I. The replica is then input to inverter 426, which outputs a cancellation waveform that can be considered −I. The cancellation waveform −I is then added to the composite waveform S+I in summer 430 so that interference I is cancelled. Thus, the output of ICC 400 is an interference-cancelled waveform which represents the desired signal S.

As discussed previously herein, there are several methods by which an interference profile may be provided. In one method, the composite signal is received by an audio processor 416 that monitors the composite signal and generates an interference profile based on the detection of repetitive signal. In another method the signal received by an antenna 420 and a receiver 421 is sampled and used to develop an interference profile. In still another method, profiles are stored in a memory 422 for retrieval by interference processor 418. Information from an RFID reader 424 is used by the interference processor 418 to select an interference profile from the memory 422. Alternatively, other signal parameters are used to designate a particular stored profile for retrieval. The interference processor 418 may perform a matching algorithm between the composite signal, or a repetitive component thereof, and one or more stored interference profiles to designate a best match profile from which an interference replica waveform may be generated.

As shown in FIG. 6, when the ICC is not activated, conventional signal processing of the composite signal outputs a signal S+I to the user in which the interference is amplified as well as the desired signal S. Consequently, the user 110 may hear an uncomfortable noise, or experience poor audio signal quality when interference is present at the hearing aid 600. Conversely, when the ICC 400 is activated, the interference-cancelled signal is subsequently processed and output to the user, without the amplification of interference I. The activator circuit 500 and the ICC 400 allow the hearing aid 600 to deliver higher quality sound to the user 110 than is typically provided by conventional auditory prostheses.

It must be emphasized that the law does not require and it is economically prohibitive to illustrate and teach every possible embodiment of the present claims. Hence, the above-described embodiments are merely exemplary illustration of implementations set forth for a clear understand of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A hearing assistive device, for cancelling interference, comprising:

an interference processor; and a memory configured to store a plurality of interference profiles, the memory further having stored thereon instructions that, when executed by the interference processor, cause the interference processor to perform operations comprising receiving a composite signal including a repetitive signal component;

accessing the stored plurality of interference profiles;

comparing the repetitive signal component to the stored plurality of interference profiles to determine whether there is a stored interference profile among the plurality of stored interference profiles that is an optimal match to the repetitive signal for canceling the interference; and responsive to determining there is a stored interference profile that is an optimal match to the repetitive signal component, generating a replica waveform of the interference and outputting the replica waveform to an inverter, wherein the inverter creates, using the replica waveform, a cancellation waveform, and a summer adds the cancellation waveform to the composite signal, yielding an interference-cancelled signal.

2. The hearing assistive device of claim 1, wherein generating the replica waveform of the interference comprises selecting a stored interference profile using a signal parameter of the composite signal and generating the replica waveform based on the selected stored interference profile.

3. The hearing assistive device of claim 1, wherein generating the replica waveform of the interference comprises:

capturing a radio-frequency signal at an antenna;

receiving, using the receiver, the radio-frequency signal captured;

determining a signal parameter of the radio-frequency signal received;

selecting a stored interference profile using the signal parameter of the radio-frequency signal received; and generating the replica waveform based on the selected stored interference profile.

4. The hearing assistive device of claim 1, wherein generating the replica waveform of the interference comprises generating the replica waveform based on the stored interference profile that is determined to be the optimal match to the repetitive signal component.

5. The hearing assistive device of claim 1, wherein the inverter creates the cancellation waveform by inverting in phase the replica waveform.

6. The hearing assistive device of claim 1, wherein generating the replica waveform of the interference comprises:

selecting a stored interference profile based on information identifying the hearing assistive device; and generating the replica waveform based on the selected stored interference profile.

7. A method, for cancelling interference in a hearing assistive device, comprising:

receiving, by an interference processor, a composite signal including a repetitive signal component;

accessing, by the interference processor, a stored plurality of interference profiles;

comparing, by the interference processor, the repetitive signal component to the stored plurality of interference profiles to determine whether there is a stored interference profile among the plurality of stored interference profiles that is an optimal match to the repetitive signal for canceling the interference; and responsive to determining there is a stored interference profile that is an optimal match to the repetitive signal component, generating, by the interference processor, a replica waveform of the interference, creating, by an inverter, using the replica waveform, a cancellation waveform, and adding, by a summer, the cancellation waveform to the composite signal, yielding an interference-cancelled signal.

8. The method of claim 7, wherein generating the replica waveform of the interference comprises selecting a stored interference profile using a signal parameter of the composite signal and generating the replica waveform based on the selected stored interference profile.

9. The method of claim 7, wherein generating the replica waveform of the interference comprises:

capturing a radio-frequency signal at an antenna;

receiving, using the receiver, the radio-frequency signal captured;

determining a signal parameter of the radio-frequency signal received;

selecting a stored interference profile using the signal parameter of the radio-frequency signal received; and generating the replica waveform based on the selected stored interference profile.

10. The method of claim 7, wherein generating the replica waveform of the interference comprises generating the replica waveform based on the stored interference profile that is determined to be the optimal match to the repetitive signal component.

11. The method of claim 7, wherein creating the cancellation waveform comprises inverting in phase the replica waveform.

12. The method of claim 7, wherein generating the replica waveform of the interference comprises:

selecting a stored interference profile based on information identifying the hearing assistive device; and generating the replica waveform based on the selected stored interference profile.

* * * * *